US011456520B2

(12) United States Patent
Moore et al.

(10) Patent No.: US 11,456,520 B2
(45) Date of Patent: Sep. 27, 2022

(54) PORTABLE SKID ASSEMBLIES

(71) Applicant: ARRIS Enterprises, LLC, Suwanee, GA (US)

(72) Inventors: Charles Sidney Moore, Langhorne, PA (US); Nicholas E. Burmylo, Florence, NJ (US); Rick Thomas Macias, Bethalto, IL (US); Douglas Alexander Ridley, Newport, NC (US); John Gatewood, Lee's Summit, MO (US); Matthew J. Kuester, Chippewa Falls, WI (US)

(73) Assignee: ARRIS Enterprises LLC, Suwanee, GA (US)

( * ) Notice: Subject to any disclaimer, the term of this patent is extended or adjusted under 35 U.S.C. 154(b) by 0 days.

(21) Appl. No.: 17/012,944

(22) Filed: Sep. 4, 2020

(65) Prior Publication Data

US 2021/0075084 A1 Mar. 11, 2021

Related U.S. Application Data

(60) Provisional application No. 62/951,195, filed on Dec. 20, 2019, provisional application No. 62/896,799, filed on Sep. 6, 2019.

(51) Int. Cl.

| | |
|---|---|
| ***H01Q 1/12*** | (2006.01) |
| ***B65D 19/00*** | (2006.01) |
| ***H01Q 1/10*** | (2006.01) |

(52) U.S. Cl.

CPC ..... *H01Q 1/125* (2013.01); *B65D 19/0095* (2013.01); *H01Q 1/10* (2013.01); *H01Q 1/1242* (2013.01)

(58) Field of Classification Search

CPC ..... H01Q 1/125; H01Q 1/1242; H01Q 1/10

See application file for complete search history.

(56) References Cited

U.S. PATENT DOCUMENTS

| | | | | |
|---|---|---|---|---|
| 5,980,070 | A | 11/1999 | Hulse et al. | |
| 6,888,512 | B1 * | 5/2005 | Daigler | H01Q 1/1242 343/878 |
| 10,236,820 | B2 | 3/2019 | Schmidt | |
| 2005/0162544 | A1 * | 7/2005 | Wong | G08B 13/19632 348/E7.086 |
| 2005/0241885 | A1 | 11/2005 | Burgess et al. | |
| 2008/0258931 | A1 | 1/2008 | Christensen et al. | |

(Continued)

OTHER PUBLICATIONS

International Search Report and Written Opinion Re: Application No. PCT/US2020/049476, dated Jan. 21, 2021.

*Primary Examiner* — Hoang V Nguyen

(74) *Attorney, Agent, or Firm* — Stewart M. Wiener; Myers Bigel, P.A.

(57) ABSTRACT

Portable skid assemblies are shown and disclosed. In some embodiments, the portable skid assemblies include a frame having two or more pockets sized to receive the fork of a forklift, telehandler, or pallet jack. The portable skid assemblies additionally include a support assembly having a base attached to the frame and at least one support member that moves vertically relative to the base between a retracted position suitable for at least one of storage or transport, and an extended position where the skid assembly is configured to communicate wireless signals.

18 Claims, 17 Drawing Sheets

(56) References Cited

U.S. PATENT DOCUMENTS

| | | | | |
|---|---|---|---|---|
| 2008/0061211 | A1* | 3/2008 | Madsen | H01Q 1/10 248/519 |
| 2009/0244279 | A1* | 10/2009 | Walsh | G08B 13/19636 348/143 |
| 2010/0277584 | A1* | 11/2010 | Price | F16M 11/18 248/422 |
| 2019/0249446 | A1* | 8/2019 | Partain | E04F 21/1811 |

* cited by examiner

PORTABLE SKID ASSEMBLIES

CROSS REFERENCE TO RELATED APPLICATIONS

This application claims the benefit of U.S. Provisional Patent Application Ser. No. 62/951,195 filed Dec. 20, 2019 and entitled "Portable Skid Assemblies," and U.S. Provisional Patent Application Ser. No. 62/896,799 filed Sep. 6, 2019 and entitled "Mobile Wireless Communications Systems." The complete disclosures of the above applications are hereby incorporated by reference for all purposes.

BACKGROUND

The subject matter of this application relates to portable skid assemblies for supporting connectivity and/or other equipment.

The desire for increased connectivity has expanded exponentially such that most people expect to remain connected regardless of their geographic location or the number of users in their immediate vicinity. For example, people expect to have Wi-Fi connectivity for their portable electronic devices (e.g., smart phones, tablets, laptops, smart watches, etc.) everywhere.

Some venues, such as sport stadiums, racetracks, fairs, and festivals, generally have the need to provide for user connectivity on a temporary or short-term basis, such as only around the time of the event being held at that venue. Additionally, in emergency and disaster recovery locations, existing communication systems may have been destroyed or made inoperable such that temporary or short-term communication systems are needed.

Previous solutions to address the above temporary or short-term needs include constructing temporary structures to support connectivity equipment, such as antennae, switches, transmitters, receivers, etc., or using one or more utility trailers that are towed by trucks or other vehicles and that support the connectivity equipment. However, the above solutions tend to weigh thousands of pounds, require specialized transportation, have significant footprints, and require significant time to set up. What is desired, therefore, is a portable and light weight skid assembly that can provide connectivity to users.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
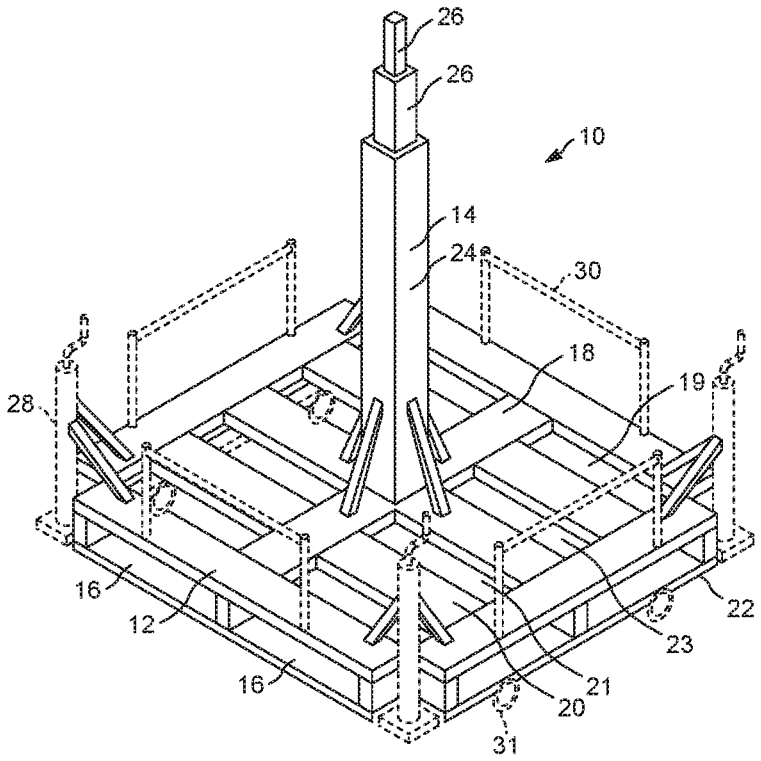
FIG. 1 is a perspective view of an illustrative example of a portable skid assembly shown with a frame with pockets and a support assembly attached to the frame, and optionally signage supports, trailer jacks, and wheels.

Referring to FIG. 1, an illustrative example of a portable skid assembly 10 is shown. Unless explicitly excluded, portable skid assembly 10 may additionally, or alternatively, include the components of one or more other portable skid assemblies described in the present disclosure. Skid assembly 10 includes a frame 12 and a support assembly 14. In the example shown in FIG. 1, frame 12 includes two or more pockets (or tunnels) 16, which receive the fork of a forklift, telehandler, and/or pallet jack to allow it to lift, transport, lower, and/or otherwise move portable skid assembly 10. Pockets 16 may also be referred to as "slots" or "channels." Additionally, in the example shown in FIG. 1, frame 12 is in the form of a pallet having first longitudinal members (or panels) 18 spaced to define first apertures 19 therebetween. The first longitudinal members are supported on transverse members (or panels) 20. The transverse members are spaced to define second apertures 21 therebetween. The example of FIG. 1 also shows frame 12 including second longitudinal members (or panels) 22 that are spaced to define third apertures 23 therebetween. The transverse members are disposed between the first longitudinal members and the second longitudinal members. Frame 12 may be made of any suitable materials, such as one or more metals. Other embodiments of frame 12 may exclude the second longitudinal members.

Frame 12 may, in some examples, be a rectangular prism or a square prism. Additionally, the frame may have standard pallet sizes and dimensions to allow commercial carriers to transport and/or store skid assemblies 10. When used in North America, the width and length in inches of frame 12 may be 48×40, 42×42, 48×48, 40×48, 48×42, 40×40, 48×45, 44×44, 36×36, 48×36, 35×45.5, or 48×20. Height of frame 12 in inches may be 5.55, 5.71, or 5.98. When frame 12 includes standard dimensions based on the International Organization for Standardization, the width and length in inches of the frame may be 48×48, 39.37×47.24, 44.88×44.88, 42×42, 43.3×43.3, or 31.5×47.24. Other dimensions include widths of approximately four feet and lengths of approximately five feet or less. The above width dimensions may allow two of the skid assemblies to be loaded side-by-side in a standard semi-trailer for ease of transport. In some examples, the length and width of the frame is significantly larger than the height or depth.

Support assembly 14 includes a base 24 and at least one support member 26, which may be collectively referred to as a "mast" or "mast assembly." Base 24 is attached to frame 12. The example of FIG. 1 also includes reinforcing members (or legs) to reinforce the attachment of the base to the frame. Support member 26 moves between a retracted position suitable for at least one of storage or transport (and/or where the support member is adjacent the base), and an extended position where the skid assembly is configured to communicate wireless signals (and/or where the support member is spaced from the base relative to the retracted position). When supported on a horizontal surface, the support member moves vertically (e.g., perpendicular to the frame) between the retracted and extended positions. In the example shown in FIG. 1, base 24 is a square base tube and support members 26 includes an intermediate square tube that nest in the square base tube and a square top tube nested in the intermediate square tube. In some examples, the support member(s) may be moved to the extended position by manually moving those members to that position.

A suitable example of support assembly 14 includes the Will-Burt Hurry-Up telescoping mast manufactured by the Will-Burt Company in Orrville, Ohio, which has a weight of twenty pounds, a height in the retracted position (or nested position) of about 6.5 feet and a height in the extended position of about 25 feet. The telescoping mast has quick lock and release collars to extend the mast manually by pushing up the sections and fixing them in position. In other examples, the support member(s) may be moved by a raising mechanism with a handle or crank (e.g., crank up stand), or by a pneumatic raising mechanism. Suitable examples include the L-11, L-13, and L-16 Crank-Up Lifts manufactured by Applied Truss and Electronics in Newport News, Va., which has a height of about 6 foot, about 6.3 foot, or about 6.5 foot in the retracted position, and a height of about 11 foot, about 13 foot, or about 16 foot in the extended position. A retracted height of about 6.5 feet or less is preferred to allow transport by commercial carriers.

In some embodiments, skid assembly 10 includes levelling jacks 28 for levelling the frame, such as when the skid assembly is supported on an uneven surface. The jacks may be attached to corners of the frame, as shown in FIG. 1. An example of a suitable jack is the Bulldog® A-frame trailer jack manufactured by Horizon Global Corporation. In some embodiments, skid assembly 10 includes signage supports 30 for supporting various signs. In the example in FIG. 1, the signage supports are in the form of U-shaped rods attached to a perimeter of the frame. In some embodiments, skid assembly 10 includes wheels 31 that are rotatably attached to frame 12.

Figure 2:
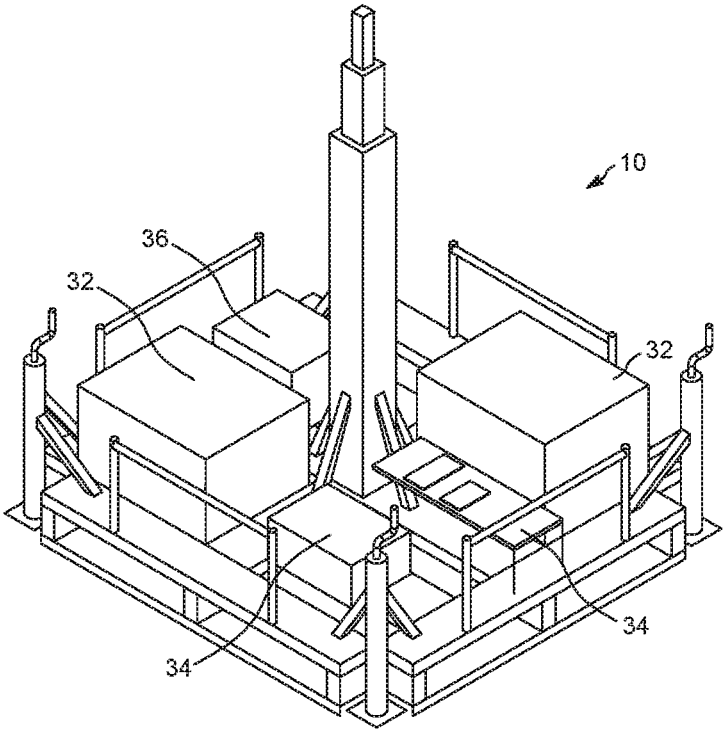
FIG. 2 is a perspective view of the portable skid assembly of FIG. 1 shown with a power assembly, fluid containers, equipment shelves, and storage compartments.

In the example shown in FIG. 2, skid assembly 10 includes one or more fluid tanks (or ballasts) 32 that are attached to frame 12 and may be filled with one or more liquids, such as water, to stabilize skid assembly 10. Skid assembly 10 also includes one or more storage shelves or cabinets 34 attached to the frame for various electronic equipment and associated parts (e.g., cables, connectors, cords, spares, etc.). The skid assembly further includes a power source assembly 36 attached to the frame to provide power to the electronic equipment. The power source assembly may include any suitable power source, such as fuel generator(s), solar panel(s), battery(ies), fuel cell(s), wind turbine(s), a plug for an electrical outlet, and/or other power sources. An example of a suitable fuel generator is the EB800i Honda portable power generator manufactured by the American Honda Motor Company. Additionally, the power source assembly may include one or more power conditioners to condition the power for the electronic components supported by the skid assembly.

Figure 3:
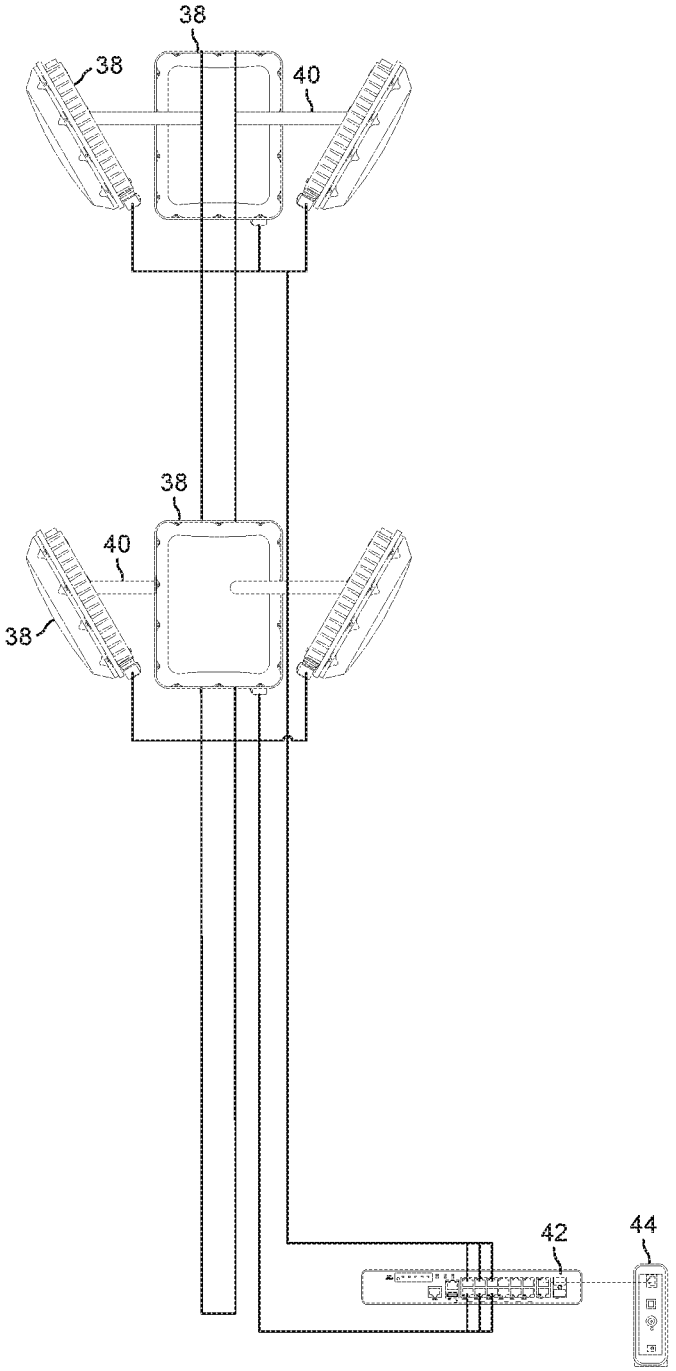
FIG. 3 is a partial front view of the portable skid assembly of FIG. 1 shown with antennae attached to the stand and other connectivity equipment supported on the skid assembly.
Figure 4:
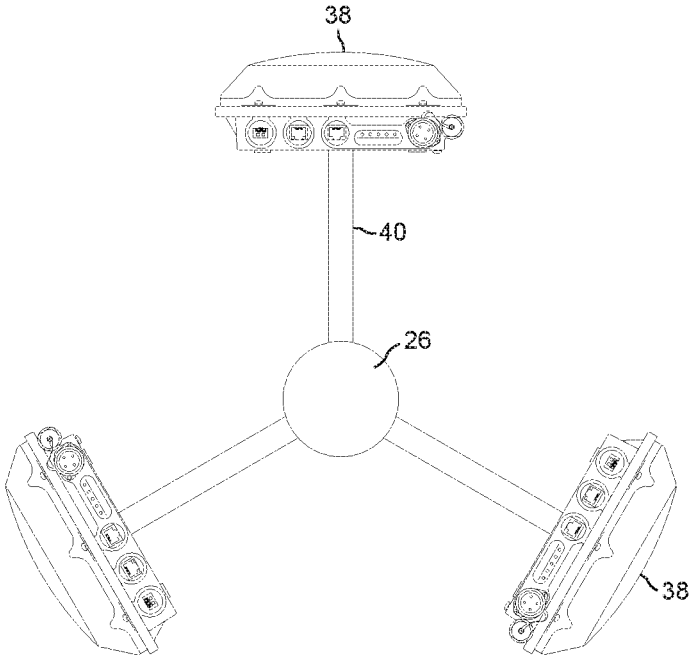
FIG. 4 is a partial top view of the portable skid assembly of FIG. 1 showing the antennae of FIG. 3.

In the example shown in FIGS. 3-4, skid assembly 10 includes a plurality of antennae 38 attached to one or more support members 26 via support rods 40. For example, when support assembly 14 is a telescoping mast, the antennae may be attached to one or more of the inner most masts via the support rods. The antennae may be spaced in any suitable way. In the example shown in FIGS. 3-4, there are two sets each having three antennae spaced circumferentially with each set spaced any suitable distance, such as three feet. The antennae are connected, such as via internal wiring, to one more switches 42, which is connected to one or more routers 44. The switches may include a plurality of ports capable of transmitting using a plurality of different types of technologies. For example, the switch may communicate using at least one of an optical interface, a coaxial cable, Ethernet, and/or portable satellite transponder. Support assembly 14 may include internal wires to connect components together. In the example shown in FIGS. 3-4, skid assembly 10 is configured to provide a Wi-Fi tower, other examples of skid assembly 10 may alternatively, or additionally, include antennae and/or other electronic equipment configured to provide a Citizens Broadband Radio Service (CBRS), a backhaul system, and/or private secure communication system. Although antennae 38 are shown in FIGS. 3-4, other electronic equipment may alternatively, or additionally, be attached to the support members, such as one or more cameras.

Figure 5:
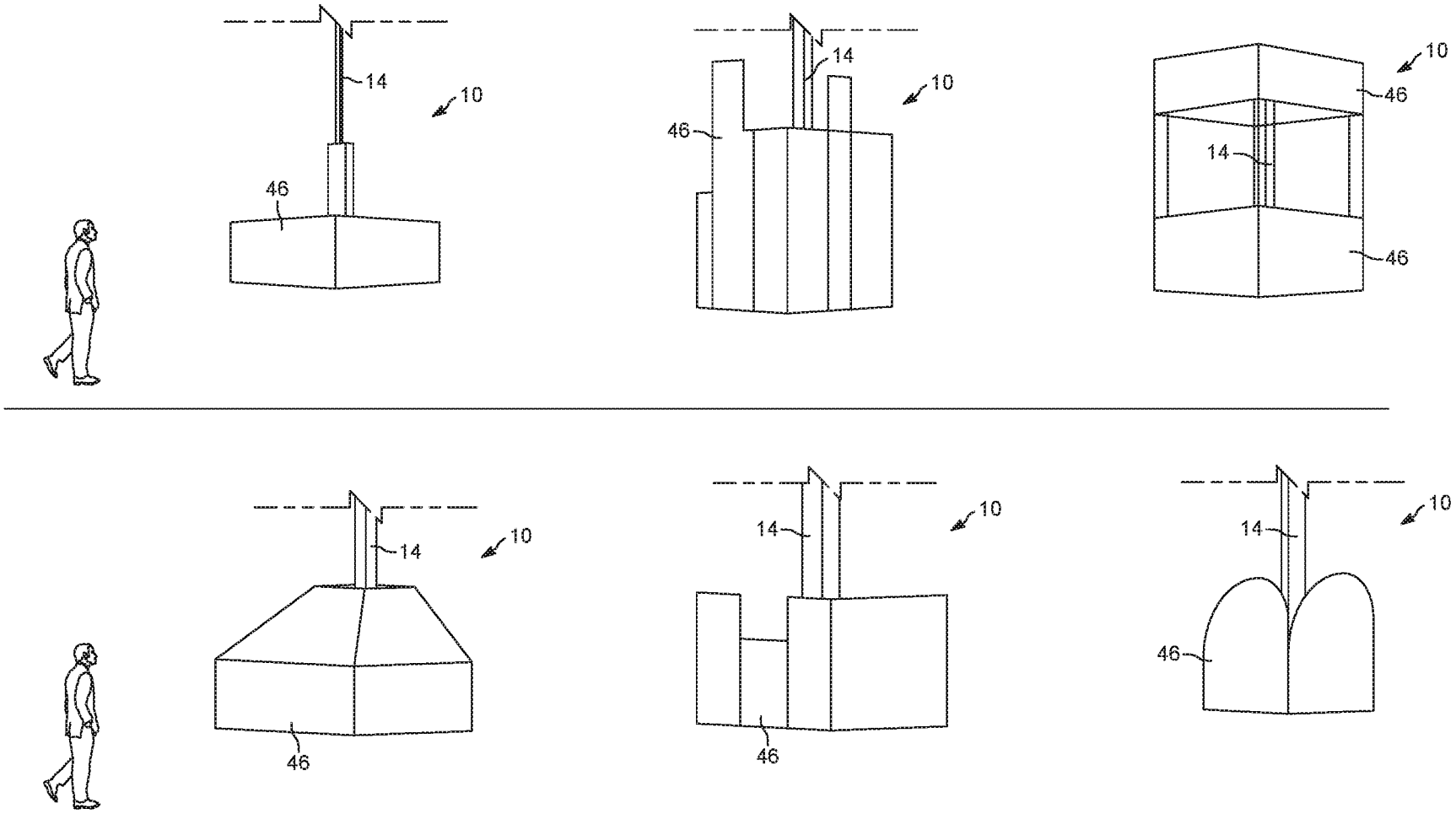
FIG. 5 are front views of the portable skid assembly of FIG. 1 showing various signage attached to the signage supports of the skid assembly.
Figure 6:
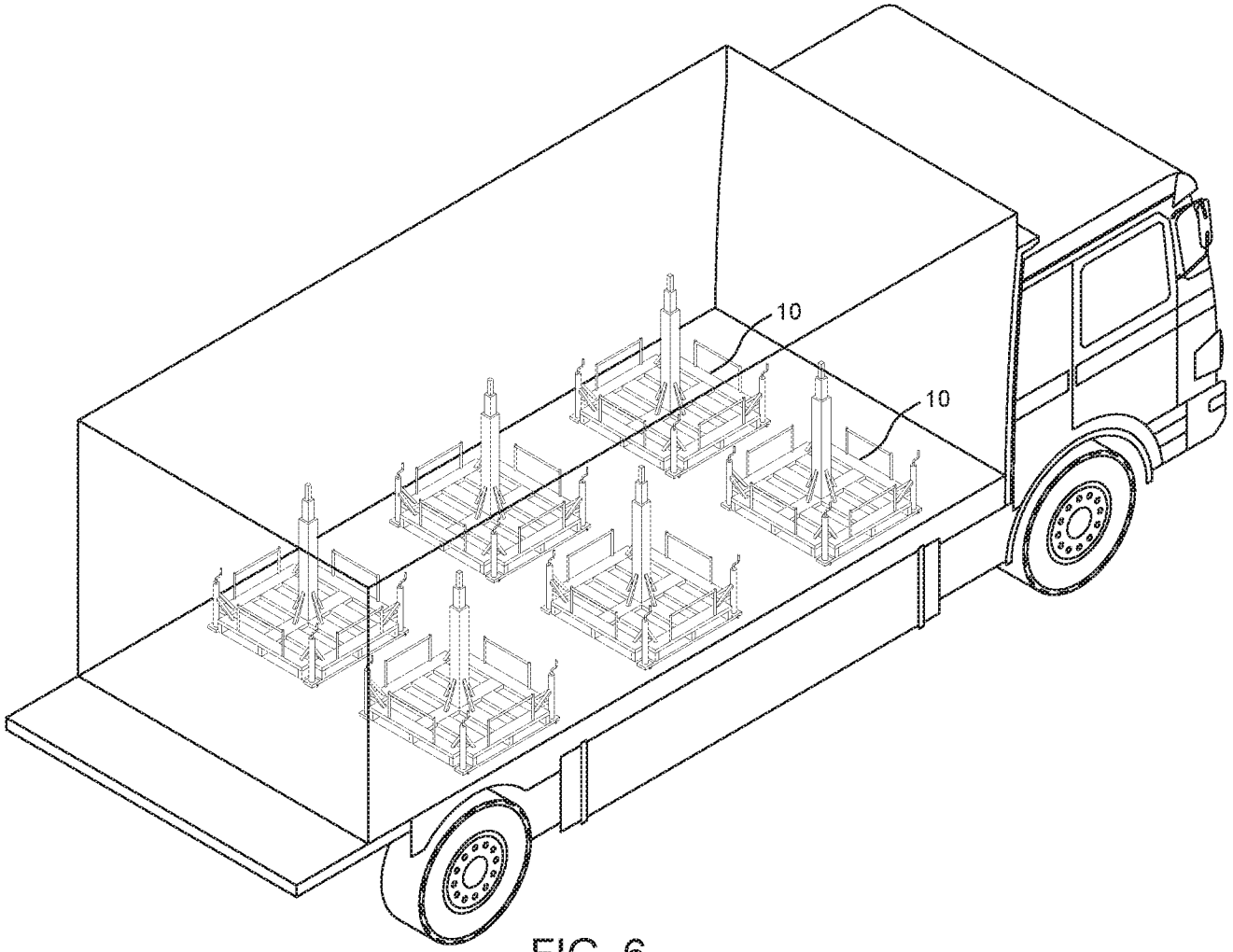
FIG. 6 is a perspective view of a truck showing six of the portable skid assemblies of FIG. 1 stored in the truck.

Referring to FIG. 5, various signs 46 are attached to signage supports 30 to cover one or more portions of skid assembly 10 and its components. Referring to FIG. 6, a plurality of skid assemblies 10 are shown loaded in a commercial truck's interior compartment. A forklift or telehandler may be used to load skid assemblies 10 onto the interior compartment. Alternatively, when a liftgate truck is used, a pallet jack may be used to load the skid assemblies in the interior compartment. The skid assemblies also may be loaded onto a van, trailer, airplane, helicopter, boat, or other vehicle.

Figure 7:
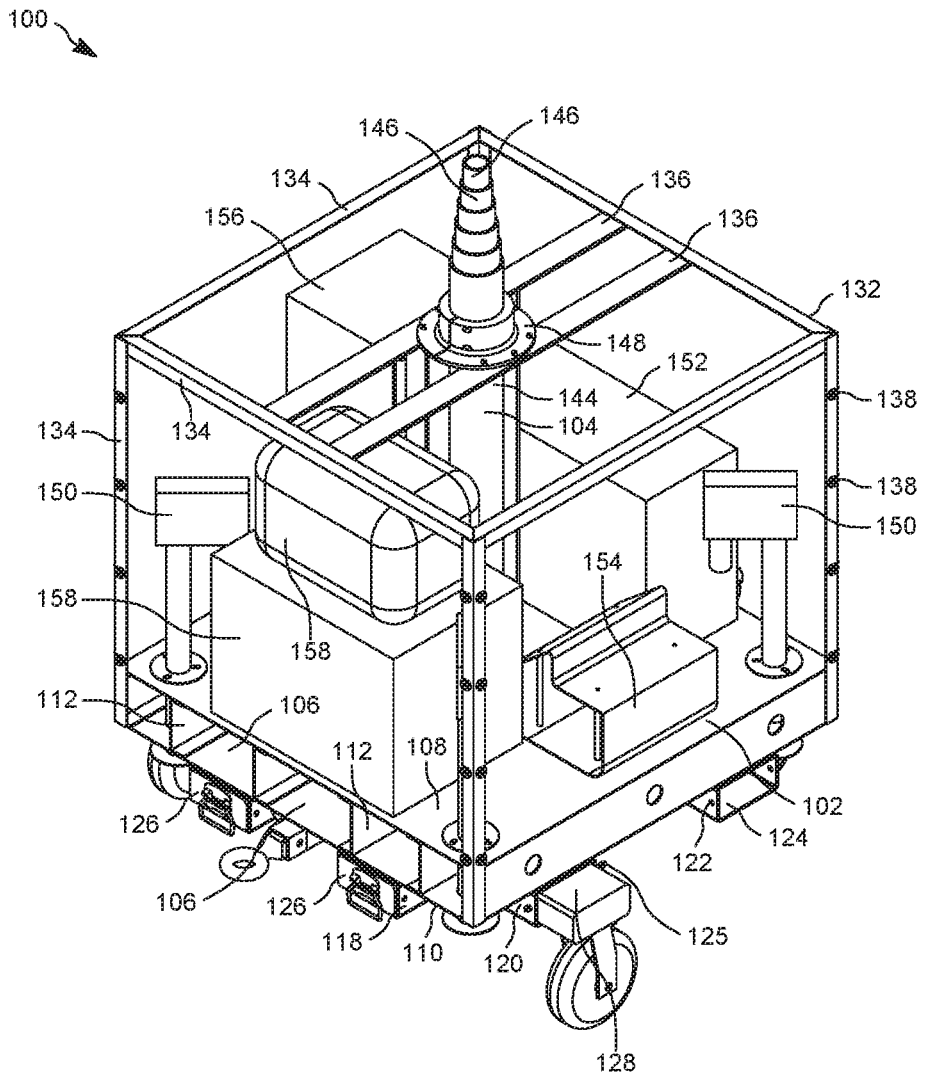
FIG. 7 is a perspective view of another example of a portable skid assembly shown with a frame having pockets and a support assembly, a power assembly, an air compressor, storage containers, and a junction box attached to the frame.
Figure 8:
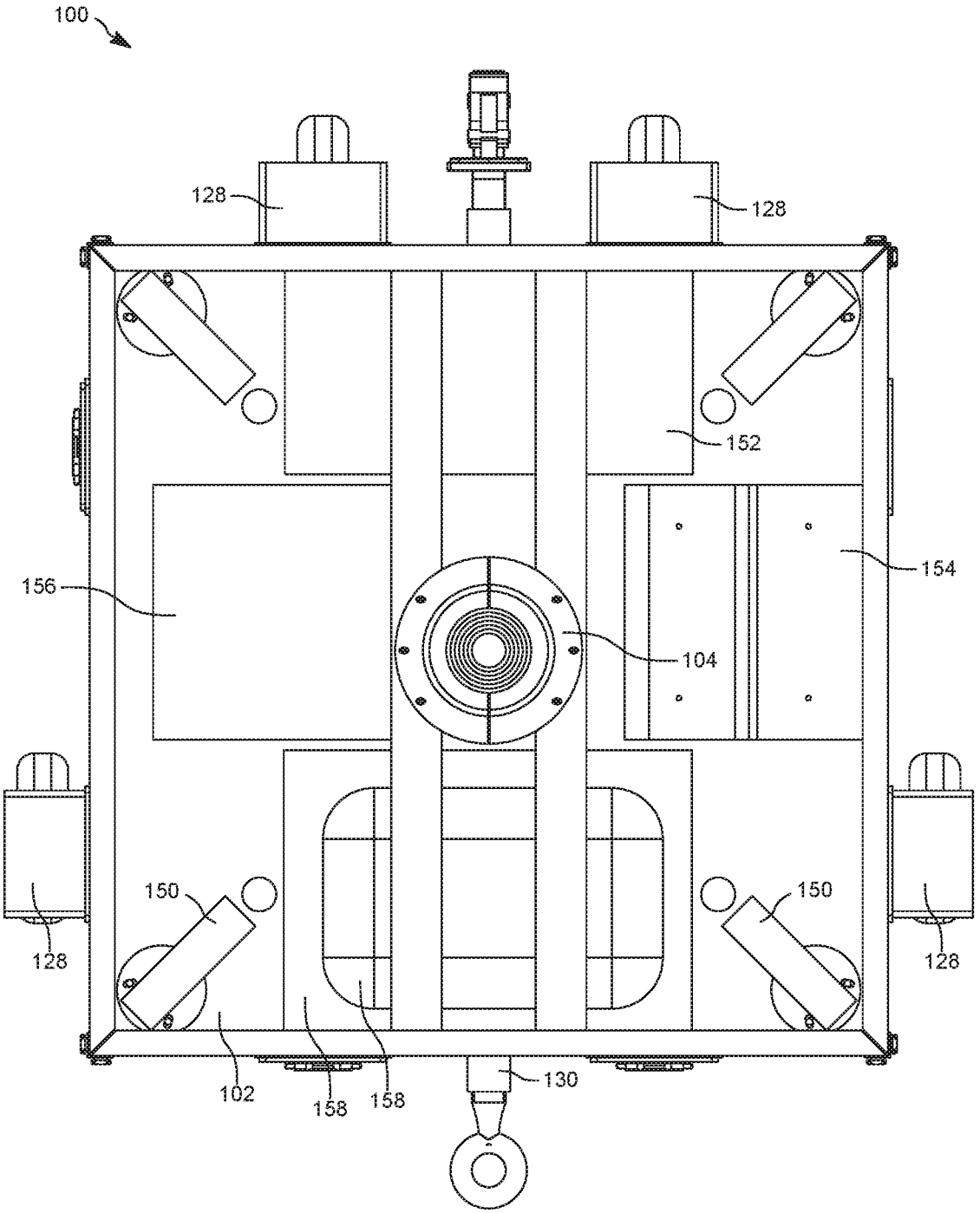
FIG. 8 is a top view of the portable skid assembly of FIG. 7.
Figure 9:
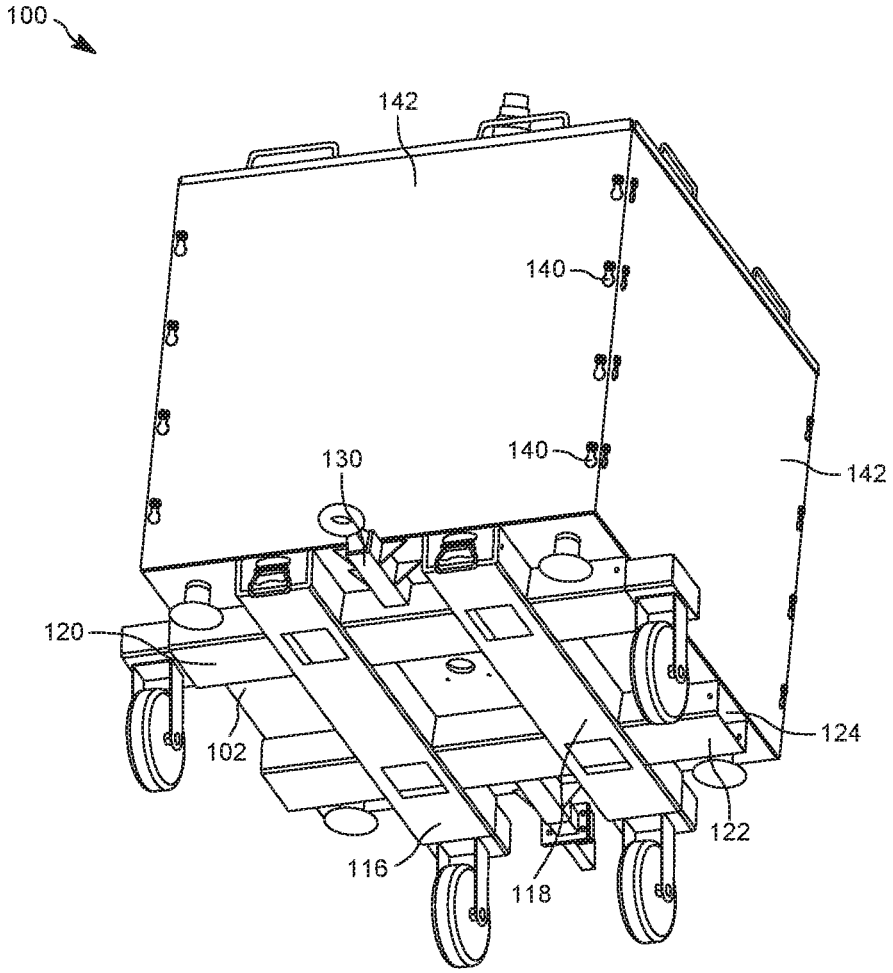
FIG. 9 is another perspective view of the portable skid assembly of FIG. 7 showing the frame having rectangular tubes attached to a lower floor plate of the frame to removably receive covers and/or wheel assemblies.

Referring to FIGS. 7-9, another example of a portable skid assembly is shown, which is generally indicated at 100. Unless explicitly excluded, portable skid assembly 100 may additionally, or alternatively, include the components of one or more other skid assemblies described in the present disclosure. Skid assembly 100 includes a frame 102 and a support assembly 104. In the example shown in FIGS. 7-9, frame 102 includes pockets (or tunnels) 106, which receive the fork of a forklift, telehandler, and/or pallet jack to allow it to lift, transport, lower, and/or otherwise move skid assembly 100. Pockets 106 may also be referred to as "slots" or "channels." Additionally, in the example shown in FIGS. 7-9, frame 102 is in the form of a cart having an upper deck plate 108, a lower floor plate 110, and a plurality of structural panels 112 disposed between the upper deck plate and the lower floor plate to define pockets 106. In the example shown in FIGS. 7-9, both the upper deck plate and the lower floor plate are planar.

As best seen in FIGS. 7 and 9, frame 102 also includes rectangular tubes attached to the bottom of the lower floor plate. In the example shown in FIGS. 7-9, frame 102 include first rectangular tube 116, second rectangular tube 118, third rectangular tube 120, and fourth rectangular tube 122. The first and second rectangular tubes are attached to lower floor plate 110 in a spaced relationship. Third and fourth rectangular tubes are attached to the lower floor plate in a spaced relationship and perpendicular to the first and second rectangular tubes such that the third and fourth rectangular tubes go through the first and second rectangular tubes.

The rectangular tubes include openings 124 that may each receive a cover 126 or a wheel assembly 128. The first, second, third, and fourth rectangular tubes provide openings 124 at various locations to allow a user to select the best locations to attach the wheel assemblies to transport the skid assembly 110. Quick-release pins 125 also may be used to secure the wheel assemblies to openings 124, while allowing for quick detachment of the wheel assemblies when desired. Alternatively, or additionally, wheels and/or wheel assemblies 128 may be selectively retractable. Frame 102 also includes a tow assembly 130 attached to lower floor plate 114. In the example shown in FIGS. 7-9, the tow assembly includes a gusset and a tow eye. Although a particular arrangement of the first, second, third, and fourth rectangular tubes are shown in FIGS. 7 and 9, other examples of skid assembly 100 may include alternative arrangements, such as arrangement to allow for a triangular configuration of wheel assemblies with one wheel assembly received in an opening in the front of the skid assembly, and two wheel assemblies received in an opening in the back of the skid assembly. Additionally, the first, second, third, and fourth rectangular tubes may have shorter lengths to allow for the wheel assemblies not to protrude outside the rest of the skid assembly to allow for tighter packing of the portable skid assembly.

Figure 10:
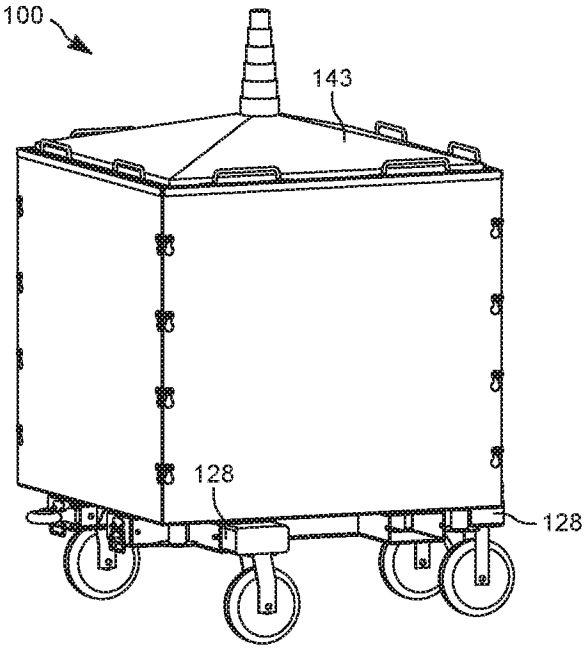
FIG. 10 is a perspective view of the portable skid assembly of FIG. 7 in a move configuration.

Frame 102 also includes a rail or brace assembly 132 attached to the upper deck plate, one or more of the structural channels, and/or the lower floor plate. The brace assembly includes perimeter rails or braces 134 and cross rails or braces 136. The perimeter braces include fasteners 138 that are received in apertures 140 of side panels 142 to allow selective attachment or removal of side panels 142. In some examples, one or more side panels may include signage and/or an electronic display. A cover panel 143 (as shown in FIG. 10) also may be selectively fastened to the top of the frame. Frame 12 may be made of any suitable materials, such as one or more metals. Additionally, the frame may be any suitable shape, such as a cube, a cuboid, a rectangular prism, or a square prism. Additionally, frame 102 preferably has sizes and/or dimensions as described above for skid assembly 10 to allow commercial carriers to transport and/or store skid assemblies 100.

Support assembly 104 includes a base 144 and at least one elongate support member 146, which may collectively be referred to as a "mast." Base 144 is attached to frame 102. In some examples, the base may be a removable fixed length pole. In other examples, the base may be tiltable, such as mounted to frame at a pivot such that the base may be rotate about the pivot (e.g., via an adjustable bracket configured to allow tilting). Alternatively, one or more support members may be tiltable. In other words, one or more support members may tilt at an intermediate point rather than at the base. A pivot may be provided at an intermediate point along the length of one or more support members where one or more support members pivot relative to the base. A locking mechanism may be used to fix the angular position of the base and/or support member(s). Additionally, an angle sensor may be provided on the skid assembly such that the angle of inclination of the base may be controlled.

The example of FIGS. 7-9 also includes a reinforcing member 148 attached to cross braces 136. Support members 146 moves between a retracted position suitable for at least one of storage or transport (and/or where the support member is adjacent the base), and an extended position where the skid assembly is configured to communicate wireless signals (and/or where the support member is spaced from the base relative to the retracted position). When supported on a horizontal surface, the support member moves vertically (e.g., perpendicular to the frame) between the retracted and extended positions. In one example, the mast may be extended up to 25 feet and retracted to approximately 80 inches or less. In the example shown in FIGS. 7-9, base 144 is a base tube and support members 146 include nested tubes received in the base tube. Alternatively, support members may be a modular multi-piece assembled pole where multiple mast members may be assembled together to create a mast of varying heights. In some examples, the support member(s) may be moved to the extended position by manually moving those members to that position. Suitable examples of support assembly 104 include a telescoping mast, a crank up stand, etc., as described in more detail above for skid assembly 10. In other examples, the support member(s) may be moved via a pneumatic system and/or a hydraulic system included in the skid assembly. In some examples, a quick lock/release collar may lock the support members to one another.

In the example shown in FIGS. 7-9, skid assembly 100 includes one or more levelling jacks 150 for levelling the frame, such as when the skid assembly is supported on an uneven surface and/or when the wheel assemblies are detached. The jacks may be attached to corners of the upper deck plate and lower floor plate (the upper deck and lower floor plates includes openings for the jacks). The jack may extend in a vertical direction, perpendicular to lower floor plate. The levelling jacks may be raised or retracted for transporting skid assembly 100, and may be lowered or extended into engagement with the ground to stabilize and level skid assembly 100. In some examples, the jack may be manually operated screw or ratcheting jacks, or may be a fluid operated jack. An example of a suitable jack is the Bulldog® A-frame trailer jack manufactured by Horizon Global Corporation. When levelling jacks are provided, at least one onboard level (not shown), such as a bubble level or electronic level, may be provided as part of the skid assembly to assist in levelling the skid assembly.

Skid assembly 100 also includes a power source assembly 152 attached to the frame to provide power to the electronic equipment, air compressor, etc. attached to the frame. The power source assembly may include any suitable power source, such as fuel or portable generator(s), solar panel(s), battery(ies), fuel cell(s), wind turbine(s), a plug for an electrical outlet, and/or other power sources. An example of a suitable fuel generator is the EB800i Honda portable power generator manufactured by the American Honda Motor Company. Additionally, the power source assembly may include one or more power conditioners to condition the power for the electronic components supported by the skid assembly.

Skid assembly 100 additionally includes an air compressor 154 attached to the frame (such as for providing air for a pneumatic raising mechanism for the support assembly). The skid assembly further includes a junction box 156 and storage containers 158 attached to the frame to store tools, additional fuel and/or water (when fuel generator(s) are used), the wheel assemblies when detached, spare electronic components, cables, extra batteries, etc. In other examples, skid assembly 100 may include a plurality of ballast bags (not shown) either removably or fixedly attached to frame 102. The ballast bags may be collapsible bags or formed as rigid containers, such as lightweight polyethylene containers. In one example, the empty ballast bags are lightweight to reduce the overall weight of skid assembly 100. The ballast bags may be filled with water (which weighs about 8 pounds per gallon) or other materials (e.g., sand, gravel, aggregate, etc.) after skid assembly 100 is deployed on site, which may provide additional weight to hold the skid assembly in position and prevent it from tipping over.

In some examples, skid assembly 100 may include a tip/motion sensor (not shown) that delivers an alarm if skid assembly 100 tips or moves in extreme weather conditions, such as high wind or hail. The tip/motion sensor may utilize a Bluetooth low energy (BLE) sensor. The tip/motion sensor may be a 9-plus axis sensor, and may be attached to support assembly 104, antennae and/or other components attached to the support assembly, or another component of skid assembly 100. The tip/motion sensor may provide remote alarms in the event skid assembly 100 moves from the original installed placement due to environmental conditions or other factors.

Skid assembly 100 may include a plurality of antennae, switch(es), router(s), etc. similar to the example shown in FIGS. 3-4. When equipped with the components shown in FIGS. 3-4, skid assembly 100 is configured to provide a Wi-Fi tower, other examples of skid assembly 100 may alternatively, or additionally, include antennae and/or other electronic equipment configured to provide a Citizens Broadband Radio Service (CBRS), a backhaul system, and/or private secure communication system. Although antennae are shown in FIGS. 3-4, other electronic equipment may alternatively, or additionally, be attached to support member(s) 146, such as one or more cameras. One or more components of skid assembly 100 may be made of hot dipped galvanized steel, aluminium, other strong and relatively lightweight material(s), or combinations thereof.

Figure 11:
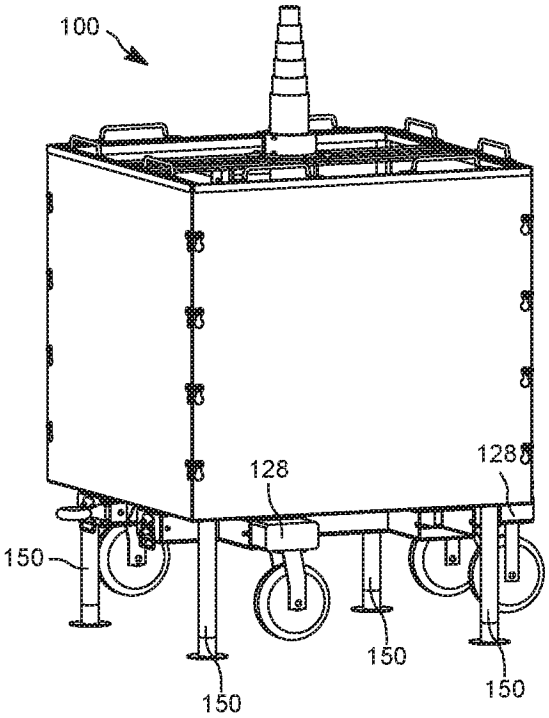
FIG. 11 is a perspective view of the portable skid assembly of FIG. 7 in a jacks-extended configuration.
Figure 12:
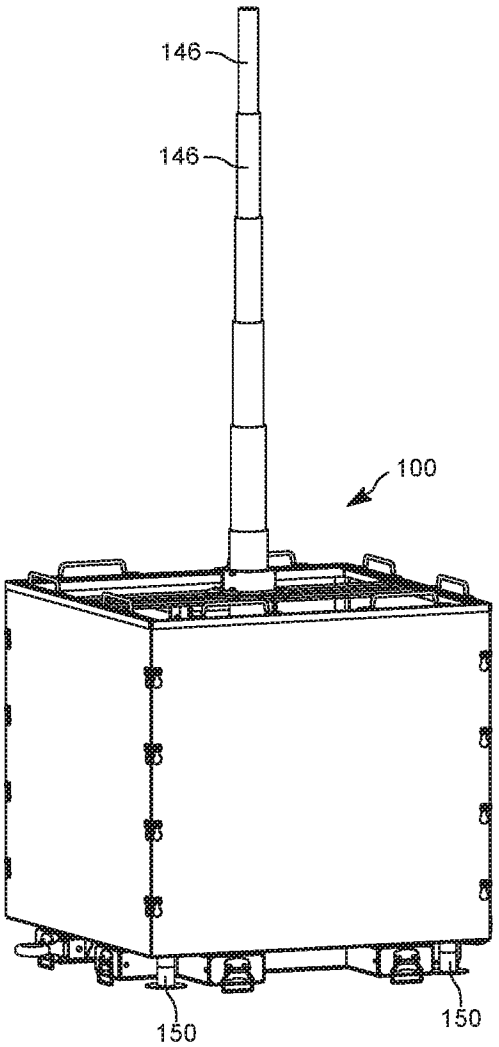
FIG. 12 is a perspective view of the portable skid assembly of FIG. 7 in an operating configuration.

Referring to FIGS. 10-12, when constructed, and during transport, skid assembly 100 preferably includes all the necessary equipment and supplies to provide connectivity other than water and fuel (when a fuel generator is used). The skid assemblies may be transported by commercial carriers, such as a truck, boat, and/or airplane, to various locations. The skid assemblies may be unloaded from those carriers using forklifts, telehandlers, and/or pallet jacks and then moved to the desired locations, such as via the forklifts, telehandlers, and/or pallet jacks and/or by rolling the skid assemblies when the wheel assemblies are attached (see FIG. 10). When in the desired locations, the levelling jack(s) may be used to raise the skid assembly to remove the wheel assemblies (see FIG. 11). When the wheel assemblies are removed, the jacks are lowered to stabilize the skid assembly (see FIG. 12). The fuel generator (when present) may be filled with fuel and water, and fluid tanks (when present) may be filled with fluids.

When included in the skid assembly, the ballast bags or fluid tanks may be filled with water, sand, gravel, aggregate, etc. to provide additional weight to hold the skid assembly in position and prevent it from tipping over. Water may preferable because it is readily available from a local water supply or by a water truck, and it is easier to remove or drain. The fuel generator may be activated, and the support assembly may be moved to the extended position (with the antenna(e) and/or camera(s)) manually, via the air compressor when a pneumatic raising mechanism is used, or via other suitable mechanism. The electronic components may then be switched on to provide the desired connectivity.

In contrast, prior art systems require delivering construction materials, power source assemblies, and electronic equipment to the sport venues or disaster relief areas, using the construction materials to build temporary structures, attaching the power source assembly and electronic equipment to the temporary structures, and connecting the electronic equipment to the power source assembly. The above steps require significant time to perform and complete. Alternatively, prior art systems require heavy-duty trucks and/or helicopters to transport utility trailers that weigh thousands of pounds to the sports venues or disaster relief areas. Additionally, there may be no road access to the sports venues or disaster relief areas for the heavy-duty trucks to deliver the utility trailers.

Figure 13:
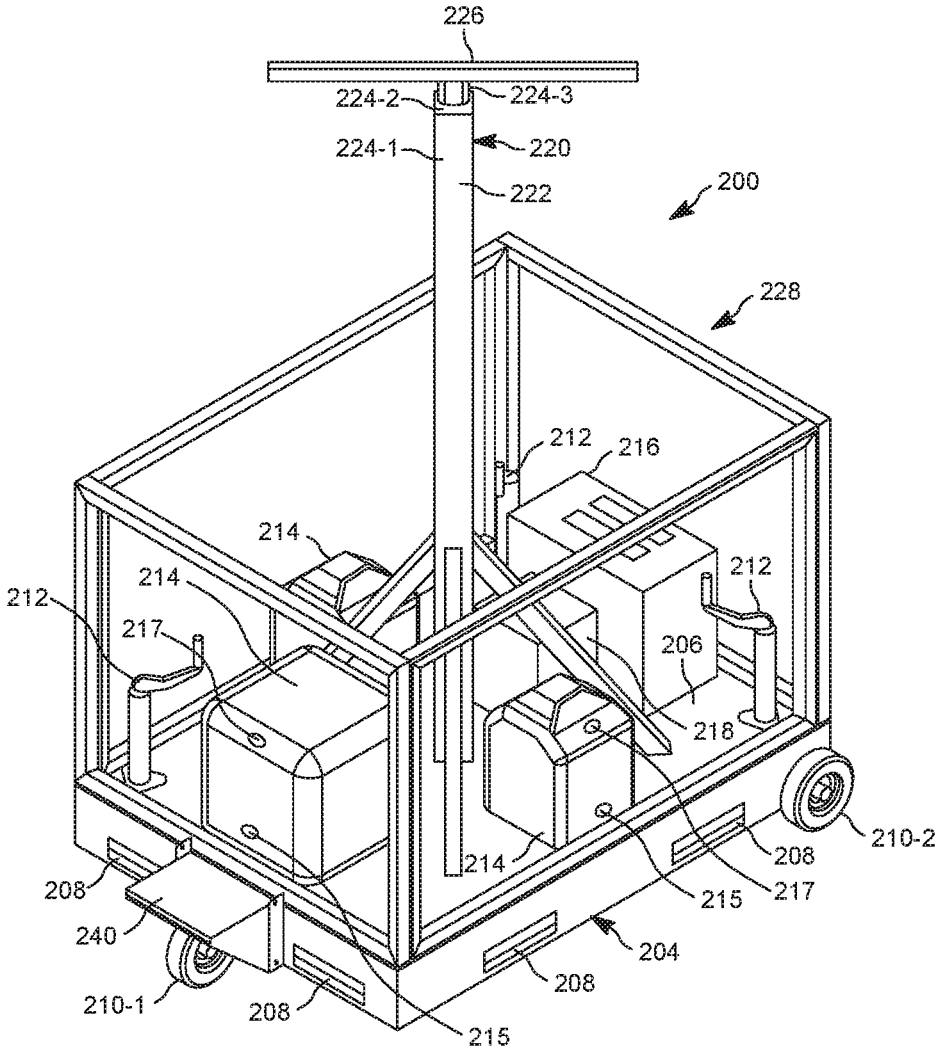
FIG. 13 is a perspective view of a further example of a portable skid assembly shown with a base having pockets and a support assembly, water ballast containers, a power source assembly, and levelling jacks.
Figure 14:
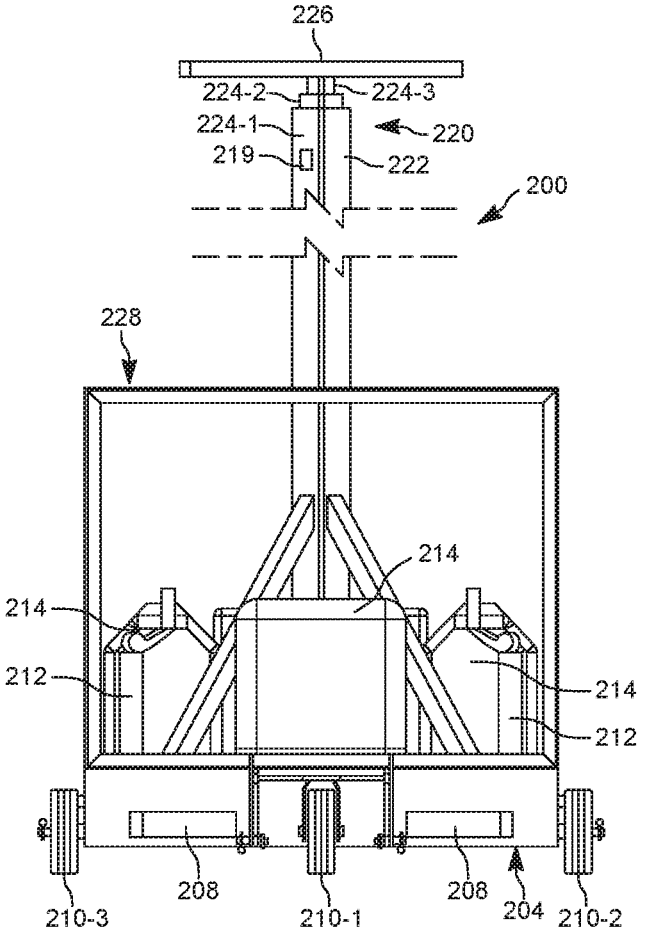
FIG. 14 is a front view of the portable skid assembly of FIG. 13.
Figure 15:
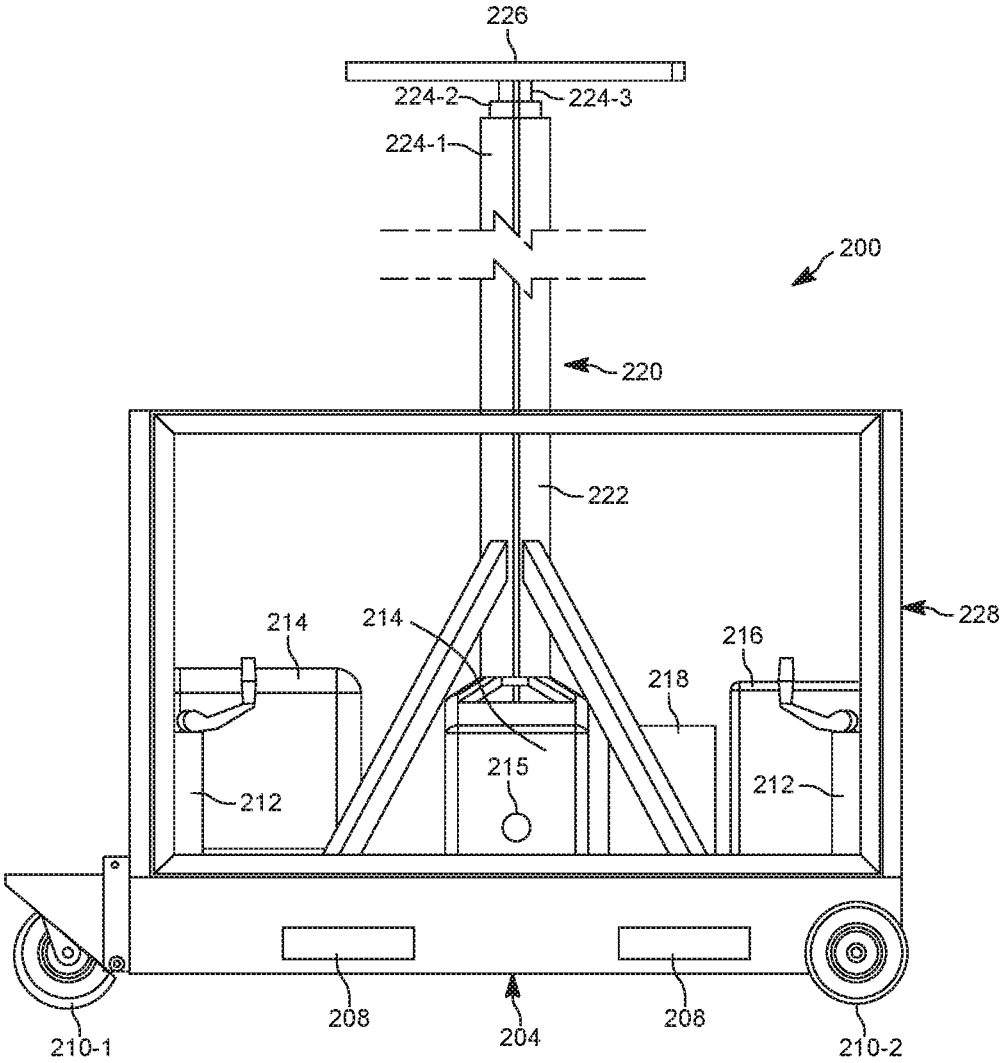
FIG. 15 is a side view of the portable skid assembly of FIG. 13.
Figure 16:
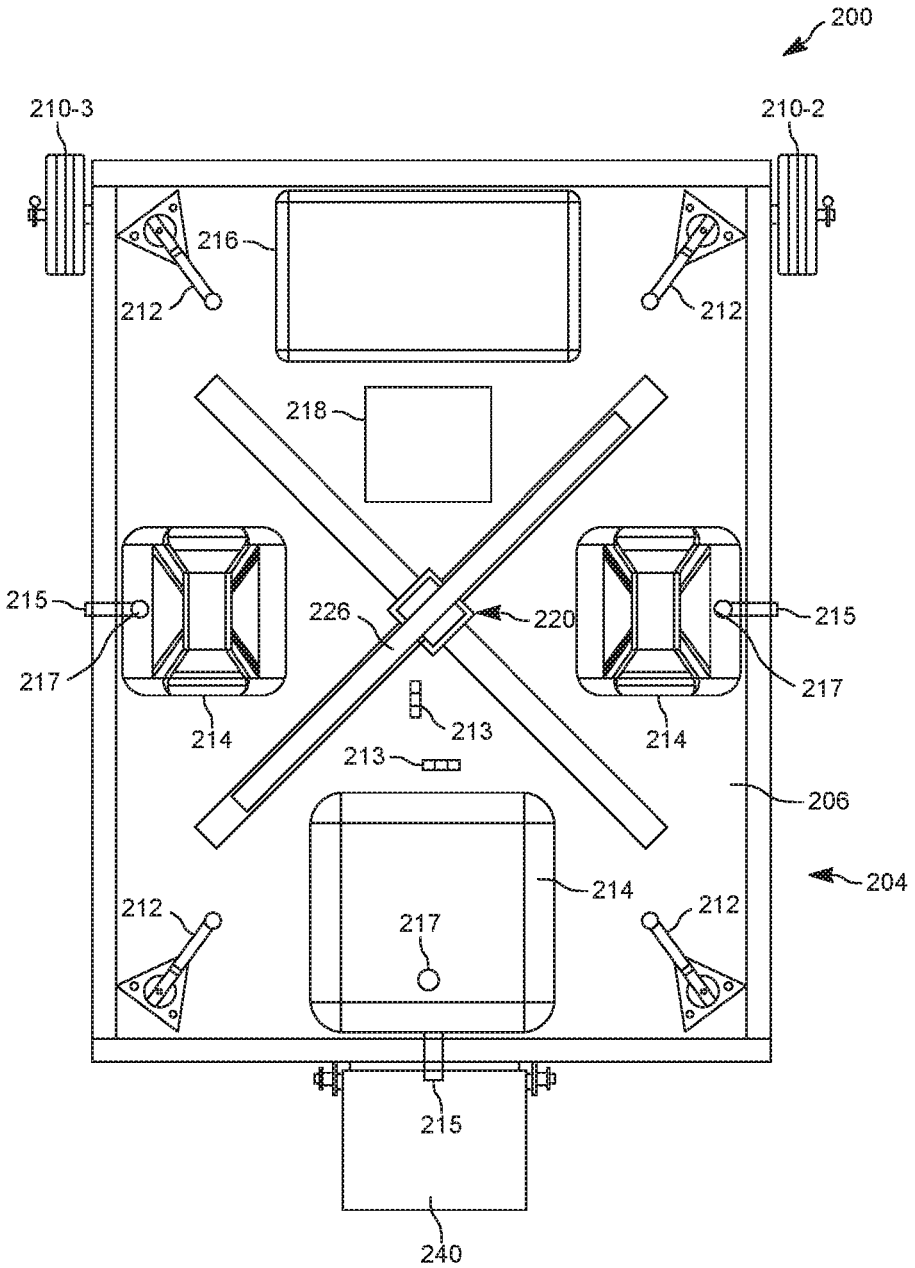
FIG. 16 is a top view of the portable skid assembly of FIG. 13.

Referring to FIGS. 13-19, another example of a portable skid assembly is shown, which is generally indicated at 200. Unless explicitly excluded, portable skid assembly 200 may additionally, or alternatively, include the components of one or more other skid assemblies described in the present disclosure. As shown in FIG. 13, portable skid assembly 200 includes a frame or skid 204 that forms a generally horizontally extending platform 206. As used in the present disclosure, the term "skid" means a portable support platform similar to a pallet and typically has a length and width significantly larger than its depth. The skid 204 may be made of hot dipped galvanized steel, aluminium or other strong, relatively lightweight material. In one embodiment, the skid 204 has a width dimension and a length dimension of approximately four feet such that the portable skid assembly 200 has a footprint that is approximately the same size as a standard pallet. In other embodiments, the skid 204 has a width dimension of approximately four feet and a length dimension of approximately five feet. The width dimension of the skid 204 allows two of the skids to be loaded side-by-side in a standard semi-trailer for ease of transport.

The skid 204 includes slots or channels 208 for receiving the forks of a forklift (not shown). Slots 208 may also be referred to as "pocket" or "tunnels." The forklift may transport the portable skid assembly 200 over short ranges either for storage and warehousing of the units when not in use or for positioning the portable skid assembly 200 on site during deployment. For long distance transport, portable skid assembly 200 may be loaded onto a truck, van, trailer, airplane, helicopter, boat or other vehicle. The slots or channels 208 facilitate the loading and unloading of portable skid assembly 200 using a conventional forklift. In other embodiments, the skid 204 may include a trailer hitch such that the skid 204 may be towed.

A plurality of wheels 210-1 through 210-3 support the skid 204 to allow portable skid assembly 200 to be rolled over the ground. In the illustrated embodiment, three wheels 210-1 through 210-3 are provided that are arranged in triangular configuration to support the portable skid assembly 200. The front wheel 210-1 may be a caster that pivots about a vertical axis to allow the portable skid assembly 200 to be steered as it is rolled over the ground. A greater or fewer number of wheels may be provided and may be arranged other than as shown to support the portable skid assembly 200. Moreover, all or a plurality of the wheels may be casters that pivot about a vertical axis. In some embodiments, the wheels may be positioned under the skid 204 such that the wheels do not protrude outside of the skid to allow for tighter packing of the portable skid assembly 200 on a truck.

The skid 204 supports at least one and, more preferably, a plurality of jacks 212. The jacks 212 extend in the vertical direction, perpendicular to the platform 206, and are provided to level and stabilize the portable skid assembly 200 in the deployed position. The jacks 212 may be raised or retracted for transporting the portable skid assembly 200 and may be lowered or extended into engagement with the ground to stabilize and level the portable skid assembly 200. The jacks 212 may be manually operated screw jacks as shown, ratcheting jacks or fluid operated jacks such as pneumatic or hydraulic jacks. In one embodiment, four jacks 212 are provided, one at each corner of the skid 204. At least one onboard level may be provided on the skid to assist in the levelling of the portable skid assembly 200. In some embodiments, the level condition of the skid 204 in the orthogonal x and y planes is detected. In some embodiments, a single level device may be used may be used to detect the level condition of the skid 204 in the orthogonal x and y planes. In other embodiments, two orthogonal levels 213 (FIG. 16) may be used to assist in levelling in the x and y planes. The levels 213 may comprise bubble levels, electronic levels or other suitable level devices.

Figure 17:
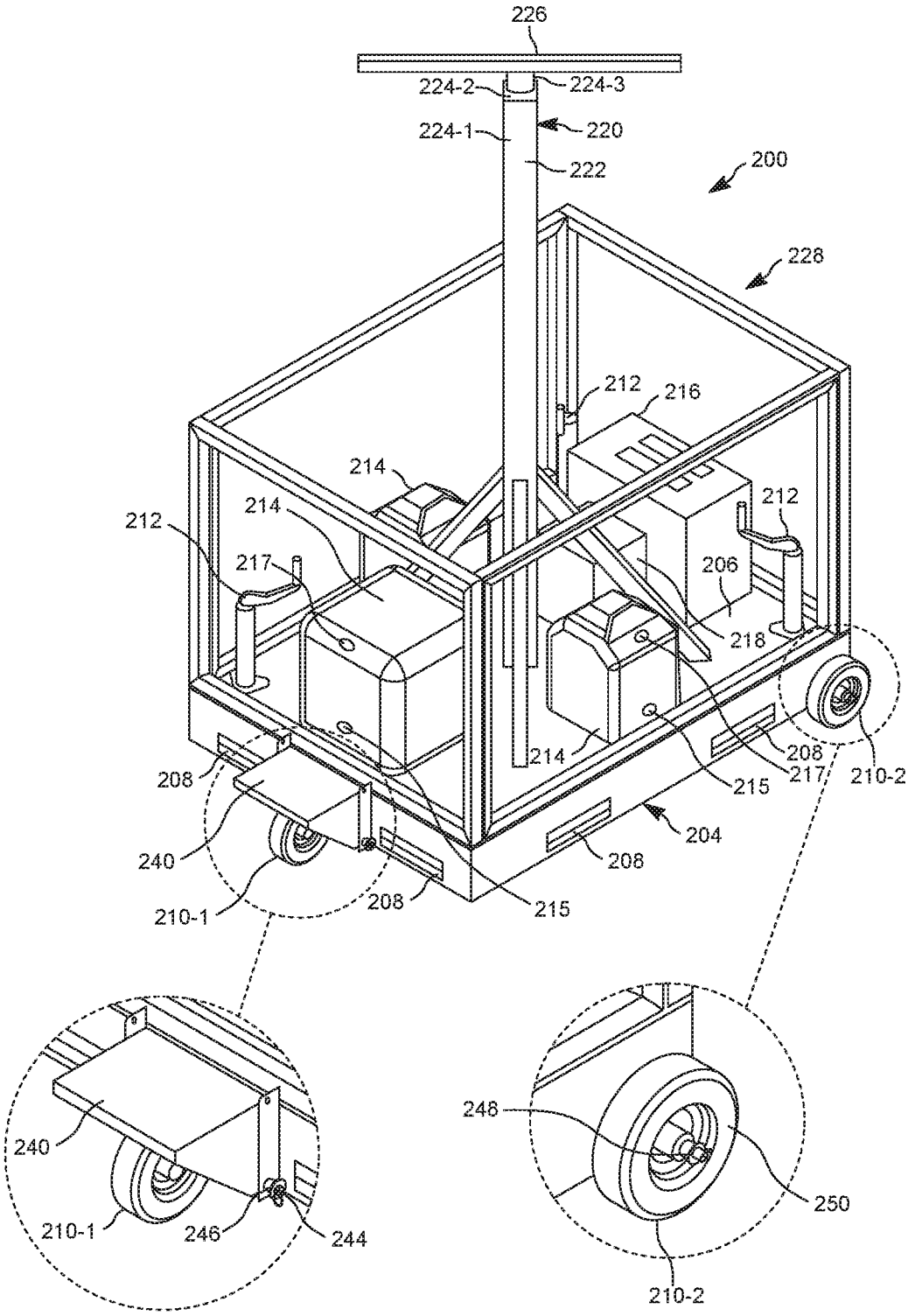
FIG. 17 is a perspective view of the portable skid assembly of FIG. 13 showing wheels in a deployed position.
Figure 18:
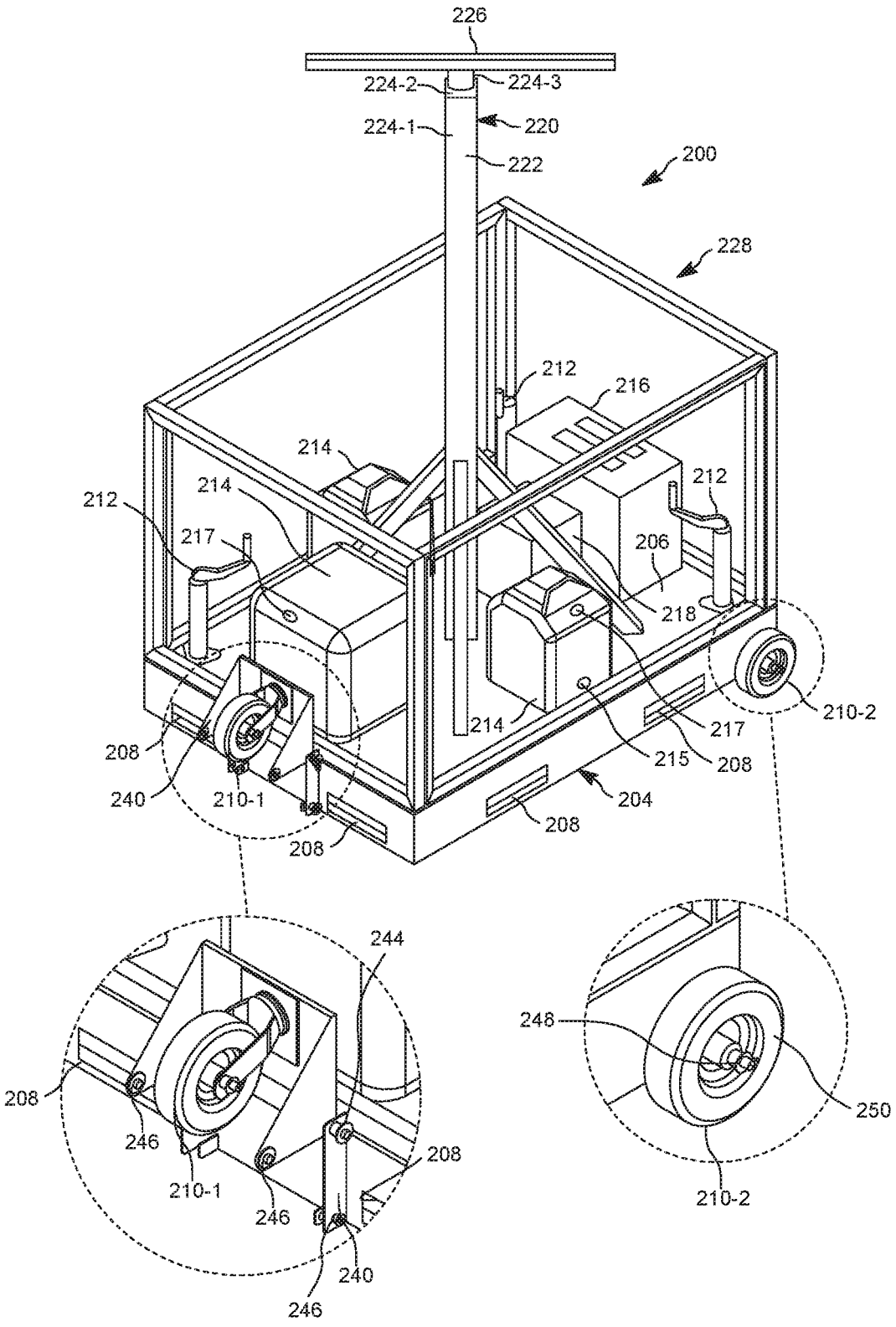
FIG. 18 is a perspective view of the portable skid assembly of FIG. 13 showing wheels in a stowed position.

At least one of the wheels may be made retractable such that the retractable wheel(s) may be stowed. In the illustrated embodiment, the front wheel 210-1 is retractable such that the portable skid assembly 200 may be rolled on the back two wheels 210-2 and 210-3. The wheel 210-1 is mounted on a movable support 240 that may be moved between an extended, deployed position (FIG. 17) where the wheel 210-1 is positioned to contact and roll on the ground and a retracted, stowed position (FIG. 18) where the wheel 210-1 is moved out of engagement with the ground. In the illustrated embodiment, the support 240 pivots between the extended and retracted positions about an axle or pins 244 and is locked in the deployed position by a lock mechanism such as quick pins 244 that engages apertures 246 (FIG. 17) in the movable support 240 and a stationary structure on the skid 204. Other pivoting and/or locking mechanisms may be used. The back wheels 210-2 and 210-3 may be removable using quick pin connections 248 that engage the axle 250 to retain the wheels on the axle. Removing the pin connections 248 allows the wheels to be removed from the axle 250 (FIG. 17). In some embodiments, all of the wheels may be made removable or retractable. When the wheels are retracted and/or removed, the skid 204 may rest directly on the ground when deployed. The jacks 212 may be used to level and stabilize the skid 204 with or without the wheels. The use of the jacks 212 and the skid as the base allows the system to be deployed without the use of guy wires or the like.

The skid 204 supports at least one and, more preferably, a plurality of ballast bags 214 on the platform 206. The ballast bags 214 may comprise lightweight polyethylene containers. The ballast bags 214 may be collapsible bags or the ballast bags may be formed as rigid containers. In a preferred embodiment, the empty ballast bags 214 are lightweight to reduce the overall weight of the portable skid assembly 200. The ballast bags 214 may be filled with water, which weighs 8 lbs per gallon, after the portable skid assembly 200 is deployed on site. The filled ballast bags 214 provide additional weight on the platform 206 to hold the portable skid assembly 200 in position and to prevent the portable skid assembly 200 from tipping over. The ballast bags 214 may be permanently secured to the platform 206 or they may be removable from the platform 206. While the ballast bags 214 may be filled with a material other than water such as sand, gravel, aggregate or the like, using water as the ballast provides certain advantages. Water is readily available and the ballast bags 214 may be filled from a local water supply or by a water truck.

Also, when the portable skid assembly 200 is to be removed from the site, the water can be drained from the ballast bags 214 onto the ground without the need for additional clean up, ballast removal or the like. In this regard, a closable fill opening 217 may be provided near the top of each of the ballast bags 214 configured to receive water from a source such as a fill hose. A closable drain 215 (which may include a conventional water hose connector, plug, and/or valve) may be provided near the bottom of each of the ballast bags 214 to drain the water after use. In the illustrated embodiment, the ballast bags 214 hold approximately 275 pounds or 35 gallons of water; however, any suitable amount of ballast may be provided and the amount of ballast weight may depend on the loading of the skid 204, the height of the mast 220, the weight of the wireless radio communications equipment supported on the mast 220, the local environment or the like. The ballast bags 214 are generally spaced around the perimeter of the platform 206 to evenly weight the system. It is noted that other equipment such as the generator 216 and electronics housing 218 add "ballast" weight and may be used in conjunction with the ballast bags 14 to evenly distribute the weight.

A tip/motion sensor 219 (FIG. 14) may also be provided that delivers an alarm if the portable skid assembly 200 tips or moves in extreme weather conditions such as high wind or hail. The tip/motion sensor 219 may utilize a Bluetooth low energy sensor (BLE) sensor. The sensor 219 may be a 9-plus axis sensor. The sensor 219 may be attached to the mast 220, wireless radio communications equipment 250, or other component of the system and may provide remote alarms in the event the portable skid assembly 200 moves from the original installed placement due to environmental conditions or other factors.

The platform 206 may also support a power source assembly 216 for generating power, such as electricity from a portable generator. In some embodiments, each portable skid assembly 200 may be powered locally by a generator that is supported on the skid 204. In other embodiments, power may be provided by connection to a nearby power grid or other nearby power source such as a solar array or wind generator, if available. Local powering of portable skid assembly 200 using power source assembly 216 may be particularly advantageous when the portable skid assembly 200 is located at a relatively large distance from a local power source, as it may help reduce power losses that occur in the cabling and avoid the need to run power cables over long distances. Local powering of portable skid assembly 200 using a gas- or diesel-powered generator may also be particularly advantageous in emergency situations where external power may not be available. In some embodiments, the generator and other components, such as the jacks 212 and mast 220, may be standard off-the-shelf components.

The advantage of using standard off-the-shelf components is that these components may be more easily replaced or repaired in the field when the portable skid assembly 200 is deployed. This is especially advantageous in emergency situations.

The platform 206 of skid 204 also supports a support assembly or mast 220, which may include a vertically extendible pole (as shown), a removable fixed length pole, or a modular multi-piece assembled pole. In a modular, multi-piece assembly, multiple mast members may be assembled together to create a mast of varying heights. The mast 220 may be bolted to the platform 206 such that it may be removable. However, in use of the portable skid assembly 200, the mast is securely fixed to the platform 206. The mast 220 may be lowered/retracted/removed/disassembled during transport and deployment of the portable skid assembly 200 and raised/extended during use of the portable skid assembly 200. The mast 220 may comprise a vertically telescoping structure 222 that comprises a plurality of elongated members 224-1 through 224-4 that nest inside of, and slide relative to, one another and may be extended to raise the mast. Any number of elongated members 224 may be used. The members 224-1 through 224-4 may be extended and retracted manually using a crank system or the members may be extended and retracted using a fluid system such as a pneumatic or hydraulic system. The members 224-1 through 224-4 may also be extended and retracted manually and use quick lock/release collars 225 to lock the members relative to one another in the extended position.

Figure 19:
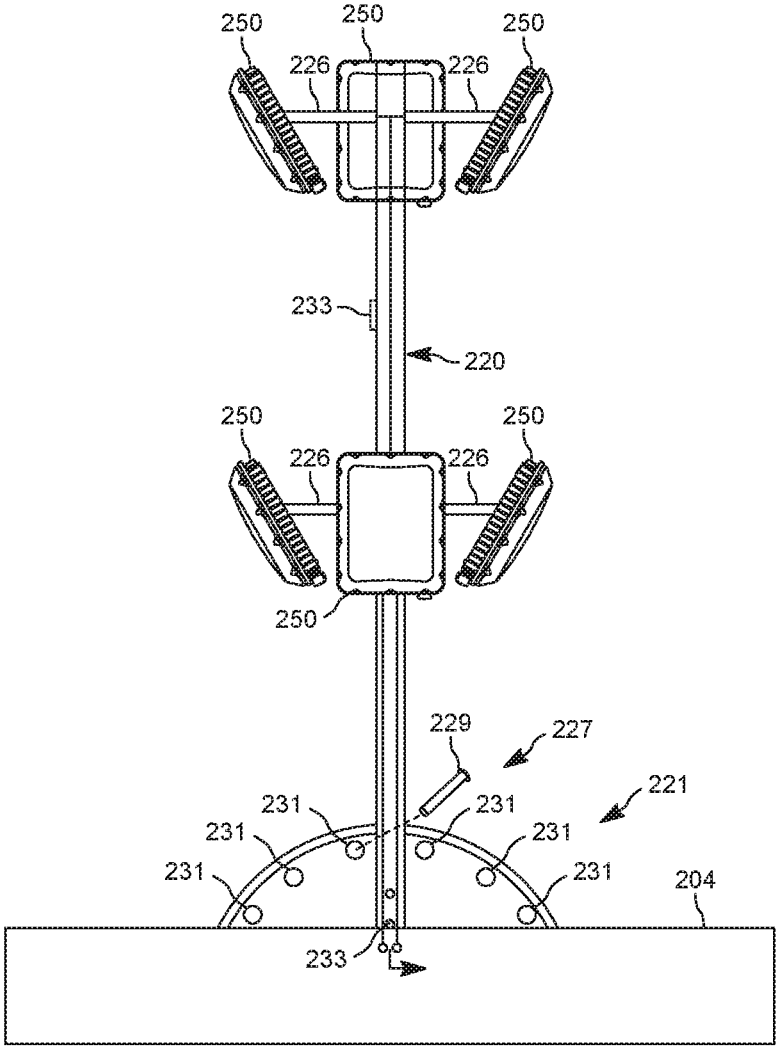
FIG. 19 is a rear view of the portable skid assembly of FIG. 13 showing another example of a support assembly that tilts relative to the frame, showing only the support assembly and the frame and without other components attached to the frame.

The mast 220 may support a support structure 226 that in turn supports the wireless radio communications equipment 250 of the radio system (FIG. 19). In some embodiments, the mast 220 may be extended up to 25 feet above the ground, although the mast may be extended to any suitable distance provided the portable skid assembly 200 is stable. The mast 220 may be retracted to a height of approximately 80 inches for ease of transportation and deployment. The mast 220 may be internally wired for security purposes to prevent tampering where cables and wires from the wireless radio communications equipment 250 to the switch 230 are located internally of the mast, FIG. 19. The mast 220 may have a payload of 20 pounds although other payloads may be provided.

In some embodiments, the mast 220 may be tiltable such that the wireless radio communications equipment 250 may be tilted during use. For example, the portable skid assembly 200 could be transported to a roof top and the mast 220 tilted to direct the wireless signals at a downward inclination over the edge of the roof. It may be desirable to tilt the mast 220 for installations other than roof top installations as well based on topography, coverage requirements or the like. In this regard, the system for mounting the mast 220 to the skid 204 may include an adjustable bracket 221 that is configured to allow tilting of the mast 220 (FIG. 19). The bracket 221 may be mounted to the skid and the mast 220 may be mounted to the bracket at a pivot 223 such that the mast 220 may rotate about the pivot 223. The pivot 223 may comprise a pivot pin supported by the bracket 221 that is inserted through an aperture in the bottom of the mast 220.

A suitable locking mechanism 227 such as a pin 229 and slot 231 arrangement, ratcheting mechanism or other suitable locking device may be used to fix the angular position of the mast. In other embodiments, the tilting of the mast may be motorized. An angle sensor 233 may be provided on the mast 220 such that the angle of inclination of the mast may be controlled. In other embodiments, the mast 220 may tilt at an intermediate point of the mast rather than at the connection to the skid 204. In such an embodiment, a pivot may be provided at an intermediate point along the length of the mast 220 where an upper portion of the mast pivots relative to the lower portion of the mast at the pivot. The position of the upper portion of the mast may be locked relative to the lower portion of the mast 220 by a suitable locking mechanism such as previously described. An angle sensor 233 may be provided on the upper portion of mast such that the angle of inclination of the upper portion may be controlled.

The portable skid assembly 200 may also comprise a brace assembly 228 to protect the system components. The brace assembly 228 may also be used as a handhold to facilitate the manual positioning of the portable skid assembly 200. As shown in FIG. 13, the brace assembly 228 may comprise an open railing. However, the brace assembly 228 may comprise walls that completely isolate the system components, other than the extending mast 220. In a completely enclosed system, at least one door may be provided to allow access to the system components.

The brace assembly 228 and the system components may also be enclosed by panels that are mounted to the brace assembly 228 and supported on the skid 204. The panels may include words, symbols or other indicia that create signage for advertising, emergency information, contact information or the like. The panels may include Silicone Edge Fabric Graphic Installation (SEG) where the brace assembly 228 is a mating SEG frame that includes a channel for receiving an edge of the SEG graphic. The panels may also include an electronic display for presenting information. The panels may be formed in a variety of shapes and sizes. The panels may be made of a rigid material such as plastic, foam, wood or metal, or the panels may be made of a soft material such as canvas. The panels may be locked to the brace assembly 228 for security purposes to isolate the system components from the external environment. In such an embodiment, the panels may be rigid and may be provided with a door or at least one of the panels may be hinged to allow access to the system components. The door or hinged panel may be lockable.

The platform 206 may also support an electronics housing 218 for retaining the electronics equipment in a secure, environmentally controlled environment. The electronics housing 218 may comprise a rugged, hardened case, cabinet or the like and may include thermal management features such as a fan. The electronics housing 218 may contain a network switch that is communicably coupled to the wireless radio communications equipment. The electronics housing 218 may also contain other electronic equipment such as a power supply for converting the electric current from the power source to the correct voltage, current and/or frequency to power the electronic equipment of the portable skid assembly 200. While a power supply may be used, in one embodiment, the electronic equipment of the portable skid assembly 200 may be run on standard voltage (e.g., 110 V), thereby eliminating the power supply and its associated weight.

The switch may comprise a switch such as a Ruckus ICX™ switch or another suitable switch. The switch provides the back-haul connection from the wireless radio communications equipment to a suitable external network, such as the Internet. To enhance flexibility, the switch may communicate using any suitable physical network such as optical, e.g. a passive optical network (PON), coaxial cable, Ethernet or the like. The switch may be provided with a plurality of ports configured to transmit data from the portable skid assembly 200 over an interface to an external network access point using different types of physical network layers such that the portable skid assembly 200 may communicate with the external network over any available interface. For example, the interface may comprise CAT6 cable. The switch is provided with multiple back haul technologies such that the portable skid assembly 200 may communicate with the external network over any one of a plurality of available interfaces.

In some embodiments, satellite communications may be desired. In such an embodiment, a second skid 204 may be provided that supports a self-contained portable satellite transponder and power source. The switch of the portable skid assembly 200 may be connected to the portable satellite transponder on the second skid to provide satellite communications capability. The second skid, that supports the portable satellite transponder, may be similar to the skid 204 as described herein with the mast and switch removed.

In many applications, a plurality of portable skid assemblies 200 may be deployed as part of a mobile wireless network. At least one of the plurality of portable skid assemblies 200 the primary system and is connected to the network using the switch. The other, secondary portable skid assemblies 200 communicate with the primary system over a wireless interface, such as a wireless bridge, in a mesh network. One example of a suitable wireless bridge is the Ruckus P300™ wireless bridge. It is to be understood that more than one portable skid assembly 200 may operate as a primary system. The mesh network may allow communication between the primary system and the secondary systems over approximately 300 feet to create a network operable over a wider area.

The wireless radio communications equipment may communicate using any available wireless technology and protocol and may comprise Wi-Fi, small cell, cellular, DAS, microwave or the like. In some embodiments, such as DAS, the wireless radio communications equipment supported by the mast 220 may only comprise the antennas with the radio equipment being supported on the platform 206, for example, in the electronics housing 218. In other embodiments, such as Wi-Fi, the wireless radio communication equipment supported by the mast 220 may comprise the antennas, radios and other equipment. One example of such wireless radio communications equipment is the Ruckus T310™ Access Point. The wireless radio communications equipment whether supported by the mast 220 or on the platform 206 is communicatively connected to the switch to allow communication to an external network.

The portable skid assembly 200 as described herein may have a total weight of approximately 600 pounds, without the water ballast. The portable skid assembly 200 may have a footprint of about 4 feet×4 feet to about 4 feet×5 feet or 16 to 20 square feet. As a result, the portable skid assembly 200 is manually movable and positionable on site without the need for a large tow vehicle, large trailer or the like. A few individuals can manually push and/or pull by hand the portable skid assembly 200 into position on wheels 210-1 to 210-3. Moreover, the portable skid assembly 200 may be towed easily by a standard passenger vehicle such as a van, pick-up truck or the like.

The portable skid assemblies of the present disclosure may be used to provide extra coverage and/or capacity when needed on a temporary basis. Given the ease of installation and set-up, this solution may help reduce capital investment while still providing coverage and capacity when needed. In addition, in some embodiments, surveillance cameras could be mounted on the portable skid assembly 200 to provide enhanced security.

The portable skid assemblies of the present disclosure may be used in a wide variety of applications. For example, in one embodiment, a portable skid assembly 200 may provide emergency cellular coverage for an individual building. Such a solution could provide automatic connectivity during power outages or local disruptions to cellular service in the same way that many buildings are equipped with generators that automatically provide power during power outages.

In a similar manner, the portable skid assemblies of the present disclosure may be used to provide increased coverage or capacity at special event venues such as sporting events, concerts, conventions and other events where a large number of users visit a site for a limited amount of time. The portable skid assemblies may be particularly well-suited to service such events when they are held at non-traditional venues that normally do not require high capacity.

The portable skid assemblies of the present disclosure could be deployed when responding to disasters or other emergency situations and could leverage Internet of Things ("IoT") and/or Software Defined Networks ("SDN") mesh networks to provide a system solution for communications, video, RF coverage and capacity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Well-known functions or constructions may not be described in detail for brevity and/or clarity. As used herein the expression "and/or" includes any and all combinations of one or more of the associated listed items.

A variety of different embodiments have been disclosed above. It will be appreciated that aspects of these different embodiments may be combined in any and all possible ways to provide a plurality of additional embodiments, and that these different embodiments may be used in any of the applications discussed herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A portable skid assembly, comprising:

a frame defining an outer periphery and having two or more pockets sized to receive the fork of a forklift, telehandler, or pallet jack;

a support assembly having a base attached to the frame and at least one support member that moves vertically relative to the base between a retracted position suitable for at least one of storage or transport, and an extended position where the skid assembly is configured to communicate wireless signals; and at least one fillable fluid tank affixed at least partially within the periphery and positioned for use as ballast when selectively filled with fluid.

2. The skid assembly of claim 1, further comprising one or more antennae attached a support member of the at least one support member.

3. The skid assembly of claim 2, wherein the one or more antennae includes at least one Wi-Fi antenna.

4. The skid assembly of claim 2, wherein the one or more antennae includes at least one Citizens Broadband Radio Service (CBRS) antenna.

5. The skid assembly of claim 2, wherein the one or more antennae includes at least one microwave radio antenna.

6. The skid assembly of claim 1, further comprising one or more cameras attached to the support member.

7. The skid assembly of claim 1, further comprising at least one air compressor attached to the frame.

8. The skid assembly of claim 1, further comprising a power source assembly attached to the frame.

9. The skid assembly of claim 8, wherein the power source assembly includes at least one fuel generator.

10. The skid assembly of claim 1, further comprising a plurality of wheel assemblies attached to the frame.

11. The skid assembly of claim 10, wherein the plurality of wheels is rotatably attached to the frame via quick-release pins to allow removal of the plurality of wheels by detaching the quick-release pins from the frame.

12. The skid assembly of claim 1, further comprising one or more trailer jacks attached to the frame and together capable of raising the frame.

13. The skid assembly of claim 1, wherein the frame includes an upper deck plate, a lower floor plate, and a plurality of structural channels disposed between the upper deck plate and the lower floor plate, and wherein the upper deck plate, the lower floor plate, and the plurality of structural channels define the two or more pockets.

14. The skid assembly of claim 13, wherein the frame further includes spaced rectangular tubes attached to the lower floor plate, the rectangular tubes include openings that removably receive one or more wheel assemblies.

15. The skid assembly of claim 1, wherein the height of the support assembly is about 78 inches or less in the retracted position, and at least about 16 feet in the extended position.

16. The skid assembly of claim 1, wherein the frame has a width less than about 48 inches, and a length less than about 48 inches.

17. The skid assembly of claim 1, wherein the at least one support member includes a plurality of telescoping members.

18. A portable skid assembly, comprising:

a cart, the cart defining an outer periphery;

a telescopic mast having a base attached to the cart and one or more telescoping members configured to move between retracted and extended positions;

one or more antennae attached to at least one of the one or more telescoping members; and at least one fillable fluid tank affixed to the cart and at least partially within the periphery, and positioned for use as ballast when selectively filled with fluid.

* * * * *